US005195252A

United States Patent [19]

Yamada et al.

[11] Patent Number: 5,195,252

[45] Date of Patent: Mar. 23, 1993

[54] METHOD FOR DRY CLEANING AS WELL AS A METHOD FOR RECOVERY OF SOLVENT THEREIN

[75] Inventors: Kiyomi Yamada; Haruo Hagiwara; Nobuharu Takagi; Hideo Tsukamoto; Yasuhiro Tsubaki; Toshio Hattori, all of Nagoya, Japan

[73] Assignee: Mitsubishi Jukogyo Kabushiki Kaisha, Tokyo, Japan

[21] Appl. No.: 746,422

[22] Filed: Aug. 16, 1991

Related U.S. Application Data

[62] Division of Ser. No. 443,723, Nov. 29, 1989, Pat. No. 5,107,605.

[30] Foreign Application Priority Data

Nov. 30, 1988 [JP] Japan ..... 63-302397
Dec. 16, 1988 [JP] Japan ..... 63-162399
Mar. 24, 1989 [JP] Japan ..... 1-33986

[51] Int. Cl.[5] ..... D06F 43/08; F26B 21/06; F26D 7/00

[52] U.S. Cl. ..... 34/26; 34/27; 34/32; 8/142; 8/141; 68/18 C; 68/20

[58] Field of Search ..... 34/74, 27, 26, 27, 32; 8/142, 141; 68/18 C, 20

[56] References Cited

U.S. PATENT DOCUMENTS 1,843,657 2/1932 Welles et al. ..... 68/209
2,189,915 2/1940 Mellor et al. ..... 34/27
3,266,166 8/1966 Führing ..... 34/32
4,086,705 5/1978 Wehr ..... 34/26
4,154,002 5/1979 Moore ..... 34/27
4,281,465 8/1981 Zimmermann et al. ..... 34/26
4,769,921 9/1988 Kabakov et al. ..... 34/32
5,107,605 4/1992 Yamada et al. ..... 68/18 R
5,123,176 6/1992 Yamada et al. ..... 34/32

*Primary Examiner*—Prince Willis, Jr.
*Assistant Examiner*—James Silbermann
*Attorney, Agent, or Firm*—McGlew and Tuttle

[57] ABSTRACT

The present invention is directed to a technique which comprises the steps of stopping the rotation of a treating drum in a deodorizing step, introducing the outside air into a treating tank through an upper opening provided in the upper portion of the treating tank or the upper portion of a recovery air duct, simultaneously exhausting a solvent gas from the treating tank through a lower opening provided in the lower portion of the treating tank or a button trap portion so slowly as not to agitate the solvent gas in the treating tank by an exhaust means connected to a solvent recovery device in the condition that the treating drum is stopped, in order to replace the solvent gas in the treating tank with the outside air, and reusing the solvent gas through the solvent recovery device once or several times. In addition, the present invention is further directed to an improvement of the above-mentioned technique. According to the above-mentioned technique of the present invention, a gas throughput which is required to recover a certain amount of the solvent in the treating tank can be noticeably miniaturized and hence it can be manufactured at a lower cost, as compared with conventional ones, and air pollution and the breakage of ozone layer can be prevented. Moreover, the solvent can be saved owing to its recovery and reuse, and occupation space for the solvent recovery device can be also saved.

2 Claims, 10 Drawing Sheets

METHOD FOR DRY CLEANING AS WELL AS A METHOD FOR RECOVERY OF SOLVENT THEREIN

This is a divisional application of application Ser. No. 07/443,723, filed Nov. 29, 1989, now U.S. Pat. No. 5,107,605.

FIELD OF THE INVENTION AND RELATED ART STATEMENT

The present invention relates to a method and an apparatus for dry cleaning which uses an organic solvent such as perchloroethylene, FLON 113 and 1,1,1-trichloroethane, and a method and a device for the recovery of the solvent in the above-mentioned apparatus.

Reference will be made to a conventional dry cleaning process in accordance with FIG. 9. In the first place, cloths 2 are thrown into a treating tank 3 through a door 1, and the door 1 is then closed and operation is started. The cleaning process generally progresses in the following order.

(1) A necessary amount of a solvent 4 is pumped up through a valve 5 from a solvent tank 3 by a pump 6, and it is then fed to a treating tank 10 through a route comprising a valve 7 and a filter 8 or another route comprising a valve 9.

(2) A treating drum 11 is then slowly rotated, and the solvent 4 is circulated through a circuit comprising the treating tank 10, a button trap 12, a valve 13, a pump 6, a valve 7 and a filter 8 or a valve 9, in order to wash the cloths.

(3) The solvent 4 is then exhausted through a route comprising the treating tank 10, the button trap 12, the valve 13, the pump 6, a valve 14 and a distiller 15, and the treating drum 11 is afterward rotated at a high speed to centrifuge the solvent 4 in the cloths 2. The thus removed solvent 4 is then exhausted in like manner.

(4) The above-mentioned steps (1) and (2) are then repeated.

(5) The solvent 4 is centrifuged and then exhausted similarly through a route comprising the treating tank 10, the button trap 12, the valve 13 and a valve 5.

(6) The treating drum 11 is slowly rotated again, and the air is circulated in the direction of an arrow 20 through a recovery air duct 19 and the treating tank 10 by a fan 16 in order to dry the cloths 2, the above-mentioned recovery air duct 19 being composed of the fan 16, an air cooler 17 and an air heater 18. A solvent gas evaporated from the cloths 2 is condensed in the air cooler 17, is then delivered to a water separator 22 through a recovery route 21, and is further returned to the clean tank 24 through a solvent pipe 23.

(7) After the drying has been completed, dampers 25, 26 are opened as shown by dotted lines, and the fresh air is taken in through the damper 25 and the uncondensed solvent gas, which has not been recovered in the air cooler 17, is exhausted through the damper 26 in order to remove a solvent odor from the cloths 2.

(8) The solvent 4 delivered into the distiller 15 in the step (3) is evaporated therein, and it is then delivered to a condenser 27 and is condensed therein. The thus condensed solvent is forwarded to the clean tank 24 through the water separator 22 and the solvent pipe 23, and it is further returned to the solvent tank 3 through an overflow partition plate 28. In this connection, water separated in the water separator 22 is discharged from the system through a water pipe 29.

Next, reference will be made to a conventional solvent recovery device in accordance with FIGS. 9 and 10. The solvent gas evaporated from the cloths 2 in the drying step is then cooled and condensed in the air cooler 17. The latter 17 is of a water cooling type, and therefore well water is used therein, whereby the solvent gas is cooled to a level of about 32° to about 35° C. As described above, the solvent gas is condensed and recovered in the air cooler 17, but the concentration of the solvent gas contained in the air is not less than a saturated concentration which depends upon temperature and pressure at this time.

For example, in the case that perchloroethylene is used, when a cooling temperature is about 350° C., it is impossible to bring the concentration of the solvent contained in the air to less than 250 $g/m^3$, with the result that the strong odor remains in the cloths 2 under such conditions.

Therefore, in the deodorizing step of the previous paragraph (7), the treating drum 11 is rotated, and the damper 25 is opened to take in a good deal of the outside air. In the drum 11, the air is brought into contact with the cloths 2 so as to lower the concentration of the solvent gas, and it is then discharged from the treating drum through the damper 26, whereby the odor is removed from the cloths 2.

However, the exhaust gas discharged by the conventional apparatus, though having been diluted, contains the solvent gas at a concentration of tens of thousands ppm at an early stage, which triggers the problem of the air pollution. When FLON 11 or FLON 113 is used and discharged into the atmosphere, this kind of compound tends to break an ozone layer surrounding the earth, and for this reason, there is the global tendency that the production of such a FLON should be inhibited. For the purposes of answering to this tendency and saving the solvent owing to the recovery thereof, in the conventional apparatus shown in FIG. 9, the diluted solvent gas exhausted through the damper 26 is led to a solvent recovery device 30 shown in FIG. 10 via a duct 37 and is then brought into contact with and adsorbed by an active carbon layer 32 in the solvent recovery device 30, whereby the solvent-free air is discharged in a clean state into the atmosphere.

Furthermore, when the solvent gas recovery power of the active carbon layer 32 has reached a saturation level, a high-pressure vapor is blown against the active carbon through a vapor pipe 33 so as to evaporate the solvent from the active carbon, i.e., to perform the so-called desorption. The evaporated solvent gas is led into a water cooling condenser 34 and is then condensed, i.e., liquefied therein, and it is further separated into the solvent and water in a water separator 35. The separated solvent is then returned to the clean tank 24. After the desorption has been completed, fresh air is taken in the solvent recovery device 30 by means of the drying fan 36 in order to dry and recover the active carbon layer 32. The thus recovered active carbon layer is ready for the next adsorption operation. The method just described is the solvent recovery method which is usually used in the deodorizing step.

However, as discussed above, the solvent gas treatment in the conventional solvent recovery device is carried out basically by first taking in a good deal of the outside air, and then discharging the solvent gas from a treating tank and a recovery air duct while the solvent gas therein is diluted and while the treating drum 11 is rotated. Accordingly, the throughput of the solvent gas is naturally increased, which triggers the aggrandisement of the solvent recovery device 30 and the increase in a device cost, an installation area and a running cost such as recovery energy. They are serious reasons for prohibiting the installation of the solvent recovery device 30.

As described above, in the conventional solvent recovery device, a good deal of the outside air is taken in, and the solvent is recovered while the treating drum is rotated and while the solvent gas in the device is diluted. Therefore, there is the problem that the device is aggrandized inconveniently. Thus, the present invention intends to solve this problem.

FIG. 11 minutely shows the whole constitution of one example of a conventional dry cleaner.

In this drawing, reference numeral 310 denotes a washing container, and washing is dry cleaned in this washing container 310. The latter 310 has a door 312 through which the washing is taken in and taken out. Furthermore, in the upper portion of the container 310, an air inlet 314 is provided which can be opened and closed by a movable damper 316, which can be controlled by an actuator 318. The door 312 and the damper 316 are provided with suitable gaskets (not shown) so that they may be closed in a completely airtight state. A dotted line depicted in the container 310 indicates a washing basket 320 having holes which can be rotated by a motor 322, which can be controlled by a speed switching actuator 324. Numeral 326 denotes a transmission belt.

Numeral 328 indicates a solvent storage tank in an airtight state, and the solvent is fed to the washing container 310 by a pump 330 immersed in the solvent. Numeral 332 is a conduit for the solvent feed and has a valve 334, which can be controlled by an actuator 336. The washing container 310 and portions combined therewith are airtightly closed at the time of the solvent feed, and therefore the air and the solvent vapor in the container are fed back to a storage tank 328 through an escape pipe 338 connecting to the storage tank 328. This escape pipe 338 has a valve 340 which can be controlled by an actuator 342 so as to close the escape pipe 338. The storage tank 328 has a cooling coil 344 therein which is connected to a cooling source.

A small-sized container 346 is a tank for storing an additive such as a surface active agent therein which can be added to the solvent. This additive storage tank 346 is connected to a lower-pressure side of a pump 348, and the additive is fed to a receiver tank 352 through a conduit 350. The latter 350 has a feed back pipe 354 connecting to the additive storage tank 346, and therefore, the additive can be returned to the storage tank 346. The receiver tank 352 is connected to the washing container 310 via a feed conduit 356 having a valve 358, which can be controlled by an actuator 360.

After the washing operation has been over, the used solvent in the washing container 310 is transferred to a distiller 368 via a conduit 362 having a valve 364, which can be controlled by an actuator 366. The distiller 368 is connected to the storage tank 328 through an isobaric conduit 370 having a non-return valve 372. A heat exchanger 374 which is, for example, in the form of a coil is disposed in the distiller 368 and is further connected to a heat source in a suitable manner. As shown in the drawing, the flow of hot water can be switched to either of the heat exchanger 374 and a conduit 378 by a two-way valve 376, which can be controlled by an actuator 380. The distiller 368 is provided with a drain line 382 having a manual valve 384.

The distiller 368 is connected to a condenser 388 via a distillate conduit 386, and the bottom portion of the condenser 388 is further connected to a liquid separator 394 via a conduit 390 and a cross joint 392. The separated solvent is returned from the separator 394 to the solvent storage tank 328 via a conduit 396.

Next, reference will be made to a recovery procedure of the solvent vapor generated in the steps of the washing operation. A large-sized conduit 398 (hereinafter referred to as main conduit) for the vapor recovery extends from a casing 400 and is connected at the terminal thereof to a solvent vapor storage tank 410. The casing 400 has a filter bag (not shown) which is exchanged periodically by opening a door 402. A fan receiving box 404 receiving a fan 406 which can be driven by a motor 408 is disposed in parallel with the casing 400, and in this case, the casing 400 is connected with the lower-pressure side of the induced draft fan so that vapor may be sucked toward the main conduit 398. The vapor storage tank 410 at the terminal of the main conduit 398 is connected to a storage tank 328 via an escape pipe 412 and is further connected to the cross joint 392 above the separator 394 via a conduit 414. The latter 414 has a branched pipe 416 connected to the conduit 396 so that the conduit 396 may not suck up all of the liquid in the separator 394. The vapor storage tank 410 has a pipe 418 having an open end capable of being suitably opened and closed by a damper 420, which can be controlled by an actuator 422. A conduit 424 extends from the bottom portion of the washing container 310 to the main conduit 398, and in the drawing, the bottom portion of the washing container 310 is shown by a dotted line. The conduit 424 is provided with a damper 426 which can be controlled by an actuator 428. Here, it should be noted that an inlet of the conduit 424 faces to the air inlet 314 of the washing container 310 in a diametral direction.

An exhaust portion of the fan receiving box 404 is connected to a conduit 430, which is connected, via an intersection 432, to conduits 434, 436 which branch in a T form. These branched conduits 434, 436 are connected to upper portions of adsorption tanks 438, 438*a*, respectively. These two adsorption tanks are mechanically identical with each other, and hence one of these tanks will be only described. The outside of the adsorption tank comprises a casing 440 which has a connection inlet 442 connecting to the branched pipe 434 or 436, and this connection inlet 442 can be opened or closed by a damper 444 which can be controlled by an actuator 446. The adsorption tank has a perforated plate 448 on the bottom thereof and is packed with an adsorbent 450 (e.g., active carbon grains) on the plate 448. In the lower portion of the perforated plate 448, an exhaust vent 452 is provided which can be opened and closed by a damper 454 which can be controlled by an actuator 456. The exhaust vent 452 of each adsorption tank is connected to a conduit 458 having an exhaust pipe 460 which extends to the outside of the apparatus.

In order to desorb the adsorbed solvent from the active carbon grains 450, vapor is used, but this vapor is fed from a vapor source through a conduit 462. In this case, the amount of the vapor is adjusted by a valve 464 which can be controlled by an actuator 466. The adsorption tank is provided on the top portion thereof with a conduit 468 having a valve 470 which can be controlled by an actuator 472, and the conduit 468 extends to a T-shaped pipe 474, from which a vapor pipe 476 extends to the condenser 478. The latter 478 is connected, via a conduit 480, to the cross joint 392 above the aforesaid separator 394. Furthermore, the condenser 478 is connected to a cold water pipe 482 and a hot water pipe 484, and the latter 484 has a valve 376 and feeds a heat source to the above-mentioned heat exchanger 374.

Next, the function of the dry cleaner will be described. This apparatus is timely operated as shown in FIG. 12 in accordance with a program timer 485. In FIG. 12, operation times are indicated by hatched portions, and non-operation times are in blank portions.

In the first place, when a certain amount of washing is placed in the washing basket 320 and the door 312 is then closed, the subsequent operation automatically proceeds in accordance with the function of the program timer 485. The pump 330 and the valves 334, 340 and 358 are simultaneously switched on, and a first batch of the solvent and a first batch of the additive are simultaneously fed to the washing container 310 from the storage tank 328 and the receiver tank 352, respectively. The solvent vapor, while being mixed with air in the container 310, starts to be fed back to the storage tank 328 through the conduit 338. Simultaneously with the commencement of the motor 322, the washing basket 320 starts to rotate at a low speed, whereby washing operation starts. When the next washing time comes, the valve 364 is opened, and the washing basket 320 is rotated at a higher speed to centrifuge the dirty solvent from the washing. The solvent is then delivered to the distiller 368 through an already opened valve 364. After this delivery has been completed, the valve 364 is closed and the washing basket 320 is rotated at a low speed again. Next, the pump 330 is operated again, and a second batch of the solvent is fed to the washing container 310 and rinsing is then carried out for a short period of time. Afterward, the valve 364 is opened again, and the solvent is delivered to the distiller 368 under the function of centrifugation in the same manner as above. After completion of the delivery, the valves 364 and 340 are closed, and drying operation begins.

On the other hand, during the washing and rinsing operations, the fan 406 is driven and the damper 420 is also opened so as to forward the air in the container into the adsorption tanks 438, **438*a* via the main conduit 398. However, the gas which is introduced into the adsorption tanks 438, 438*a* is a mixed gas of the air and the solvent vapor, because the solvent vapor storage tank 410 is already filled with the solvent vapor coming through the conduits 412, 414. When the drying operation starts, the damper 420 is partially closed in order to inhibit the outside air from coming in. Furthermore, the dampers 316, 426 are opened, so that the air around the washing container is allowed to come in through the opening 314 and is then brought into contact with the wet washing, which is being rotated, in the washing basket 320. When the air is introduced in this way, the solvent vapor is guided downward, i.e., toward the lower opening of the conduit 424, and it is then delivered to the adsorption tanks 438, 438*a* through the main conduit 398 by means of the suction force of the fan 406**.

Such a method as described above is widely carried out which comprises introducing the outside air into the washing tank by the suction force of the blower so as to dry and deodorize the washing. In this method, the greater an air flow is, the greater the effect of the drying and deodorization is. However, in adsorbing the solvent gas by the active carbon, the size of the adsorbing device is proportional to the air flow. That is, it is necessary that the solvent gas is brought into contact with the active carbon for about 1 second, and a linear velocity of the solvent gas which passes through the active carbon is widely known to be 0.3 to 0.5 m/second as a design value of the solvent gas adsorption. Therefore, the sectional area of the active carbon layer depends upon the air flow and the linear velocity, and the length (height) of the active carbon layer depends upon the contact time of the solvent gas.

That is, the apparatus shown in FIG. 11 has the problem that the apparatus itself is aggrandized inconveniently, as in the explanation of the apparatus shown in FIGS. 9 and 10.

SUMMARY OF THE INVENTION

The present invention has been achieved in view of the above-mentioned situations, and an object of the present invention is to provide a means for solving the above-mentioned problem of the conventional apparatus.

The present invention is concerned with a technique which comprises the steps of stopping the rotation of a treating drum in a deodorizing step; taking in the outside air through an upper opening provided in the upper portion of a treating tank or that of a recovery air duct; exhausting a solvent gas slowly from the treating tank through a lower opening provided in the lower portion of the treating tank or a button trap portion by an exhaust means connected to a solvent recovery device without agitating a solvent gas in the treating tank under the condition that the treating drum is stopped, in order to replace the solvent gas with the outside gas; and reusing the solvent gas through the solvent recovery device once or several times. In addition, the present invention is also concerned with an improvement of the above-mentioned technique. The technique and its improvement of the present case can be used as a means and function for solving the above-mentioned problem.

The present invention is constituted as described, and therefore a gas throughput necessary to recover a certain amount of the solvent in the treating tank can be decreased, and the solvent recovery apparatus can be miniaturized remarkably as compared with the conventional ones. In consequence, air pollution and the breakage of an ozone layer can be prevented, and the solvent can be saved owing to its recovery and reuse. Furthermore, the solvent recovery device can be manufactured at a low cost, and occupation space for the apparatus can be also saved

EMBODIMENT

Embodiment 1

Figure 1:
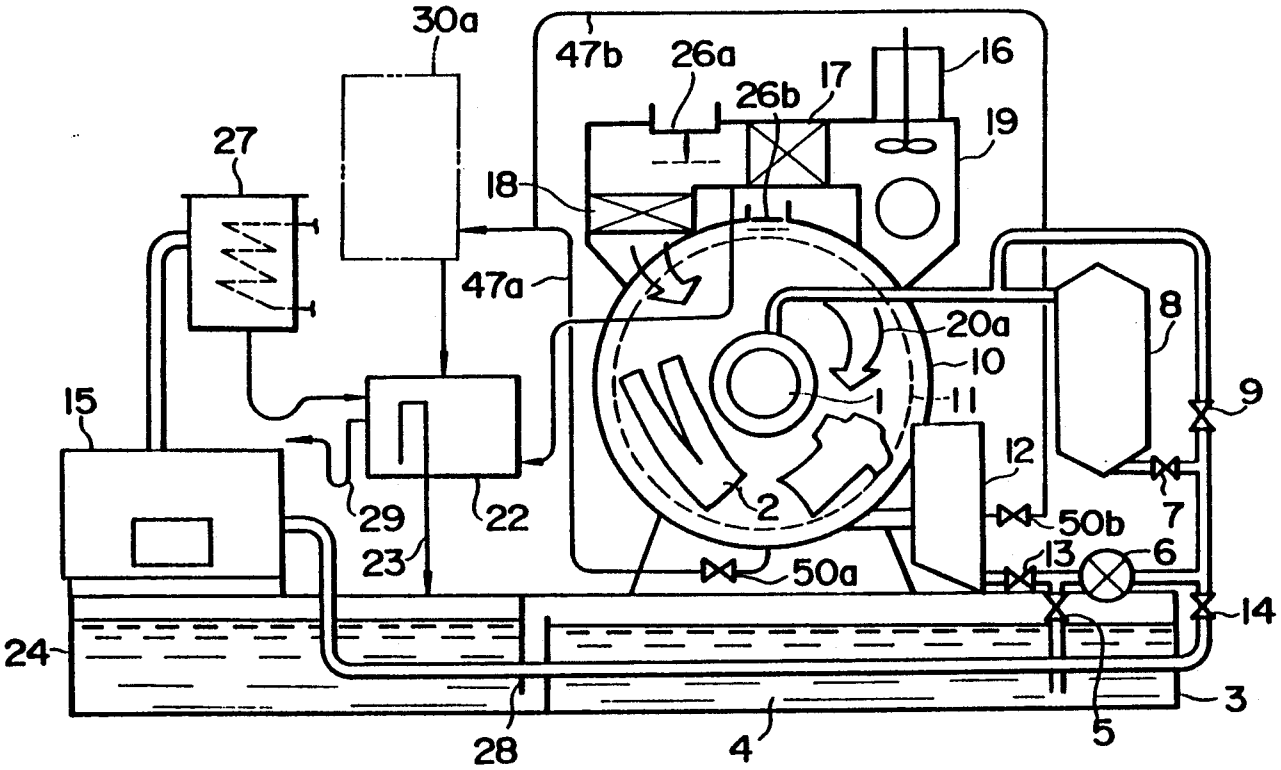
FIG. 1 is a system view of a dry cleaning apparatus regarding an embodiment of the present invention.
Figure 2:
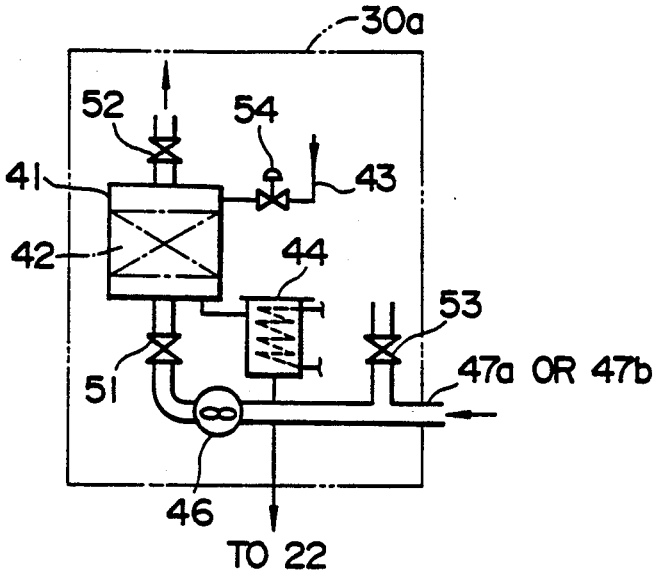
FIG. 2 is a piping view of a miniaturized solvent recovery device.
Figure 9:
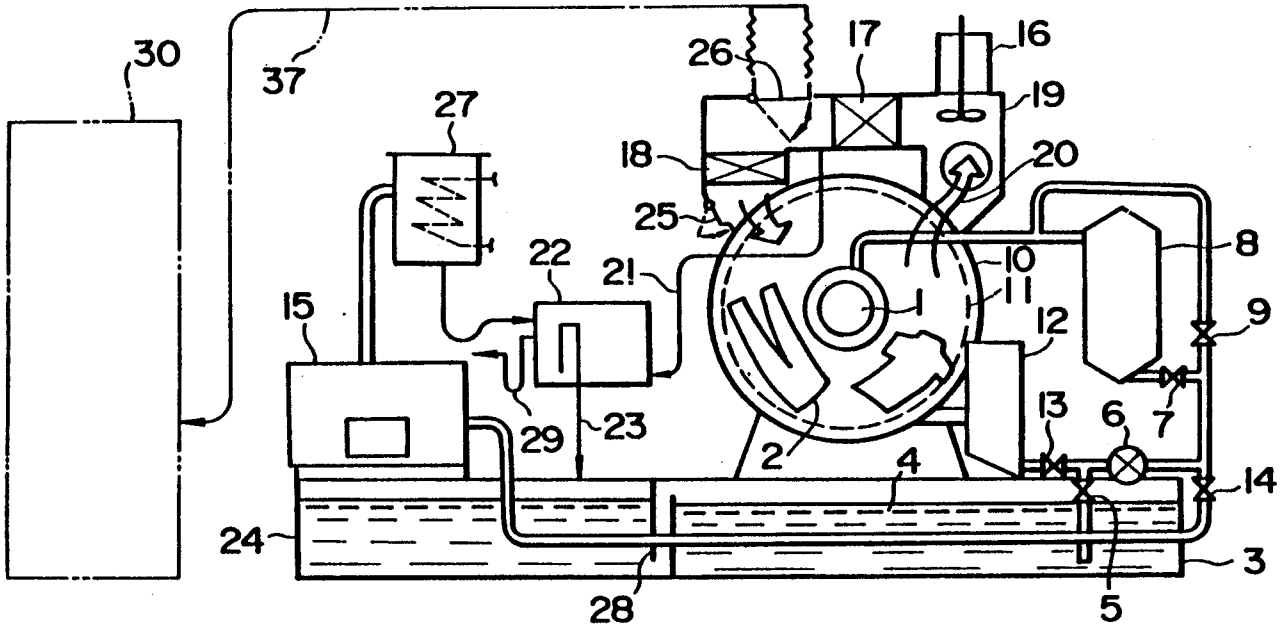
FIG. 9 (PRIOR ART)
FIG. 9 is a system view of a conventional dry cleaning apparatus.
Figure 10:
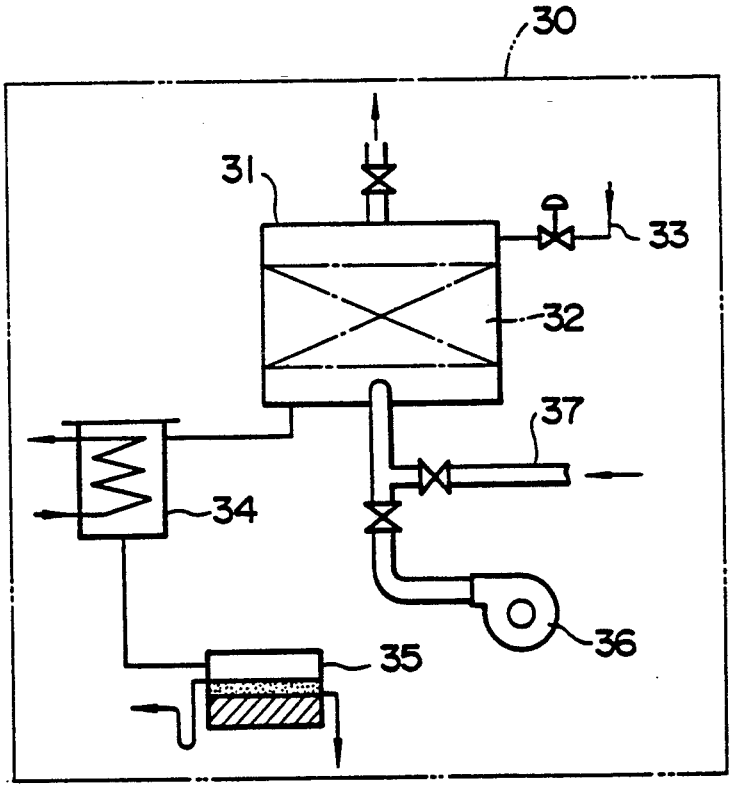
FIG. 10 (PRIOR ART)
FIG. 10 is a piping view of the conventional solvent recovery device.
Figure 11:
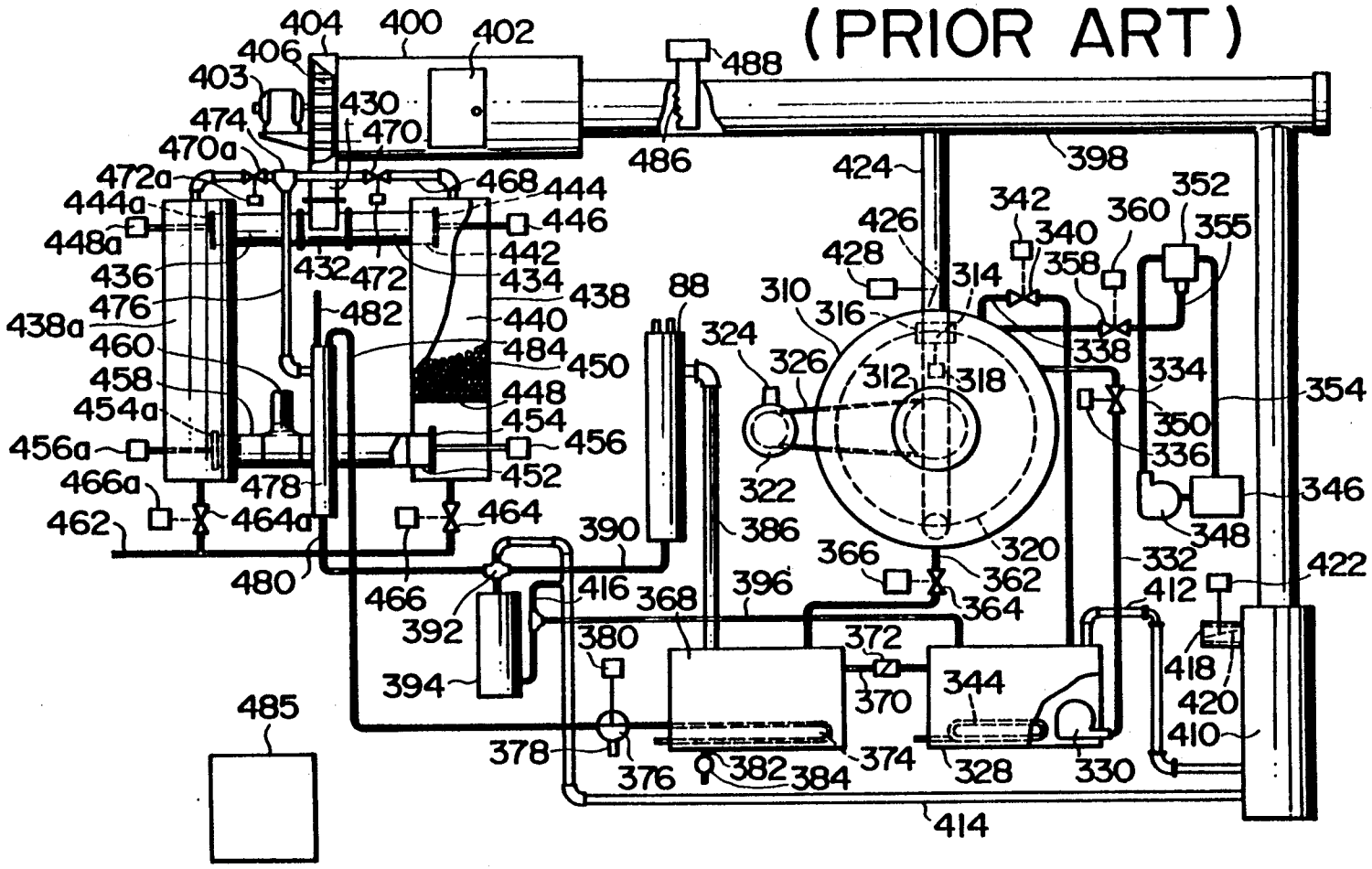
FIG. 11 (PRIOR ART)
FIG. 11 is the whole constitutional view illustrating the dry cleaner which has a conventional solvent recovery device.
Figure 12:
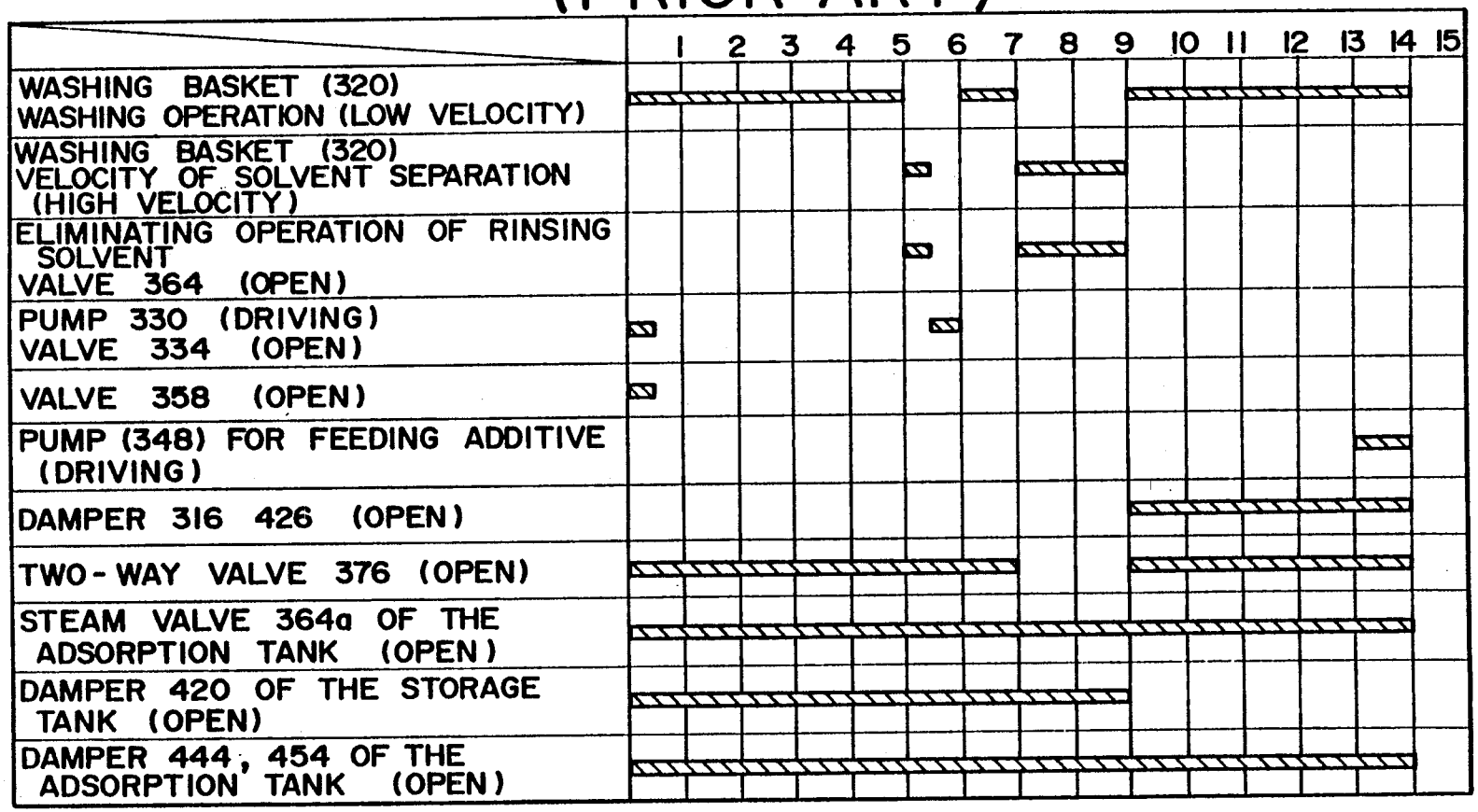
FIG. 12 (PRIOR ART)
FIG. 12 is a process chart of the dry cleaner shown in FIG. 11.

Now, the present invention will be described as Embodiment 1 in connection with drawings. FIG. 1 is a system view of a dry cleaning apparatus in Embodiment 1 of the present invention, and FIG. 2 is a piping view of a miniaturized solvent recovery device. In FIG. 1, the same members as in the conventional apparatus in FIG. 9 are denoted by the same reference numerals for explanation. The apparatus shown in FIG. 1 comprises a door 1, cloths 2, a solvent tank 3, a solvent 4, a valve 5, a pump 6, a valve 7, a filter 8, a valve 9, a treating tank 10, a treating drum 11, a button trap 12, a valve 13, a valve 14, a distiller 15, a fan 16, an air cooler 17, an air heater 18, a recovery air duct 19, a water separator 22, a solvent pipe 23, a clean tank 24, a condenser 27, a partition plate 28 having an overflow, and a water pipe 29. These members are the same as in FIG. 9, and hence their detailed explanation is omitted.

The apparatus in FIG. 1 is different from the conventional apparatus in FIG. 9 in the following points: The treating tank 10 is connected with the small-sized solvent recovery device **30*a* via a valve 50*a* or 50*b* and a duct 47*a* or 47*b* so that the solvent gas may be slowly forwarded from the treating drum 10 to the small-sized solvent recovery device 30*a* through a lower opening in the lower portion of the treating tank 10 or that of the button trap 12 under the condition that the rotation of the treating drum 11 is stopped, while the outside air is taken in through an upper opening in the upper portion of the recovery air duct 19 or that of the treating tank 10**.

Next, the small-sized recovery device **30*a* shown in FIG. 2 will be described. In the center of the device 30*a*, there is an active carbon layer 42, and its volume is about 1/10 of that of the active carbon layer in the conventional case. Furthermore, the device contains a fan 46 for sucking the solvent gas and for drying and recovering the active carbon, valves 51, 52 and 53 for switching a circuit, a vapor pipe 43 for desorption having a vapor valve 54 which is used in desorbing the solvent from the active carbon, and a water cooling condenser 44** for condensing and recovering the evaporated solvent.

Now, reference will be made to the function of the dry cleaning apparatus in which the above-mentioned small-sized solvent recovery device **30*a*** is incorporated.

In the first place, the dry cleaning apparatus performs usual washing and drying. Afterward, the treating drum 11 is stopped, and a damper **26*a* or 26*b* which is an upper opening for taking in the outside air is opened as shown by a dotted line. The valve 50*a* or 50*b* is adjusted so that the outside air may not be mixed with the solvent gas. The solvent gas in the treating tank 10 is forwarded in a direction of an arrow 20*a* to the active carbon layer 42 in the small-sized solvent recovery device 30*a* by such a low air flow as adjusted above, whereby the solvent gas is adsorbed by the active carbon and the solvent-free air is discharged into the atmosphere through the valve 52**.

When the active carbon layer 42 is saturated with the solvent gas, a high-pressure vapor is blown against the active carbon layer 42 through the vapor pipe 43 in the same manner as in the conventional case, in order to evaporate the solvent from the active carbon, i.e., to carry out the so-called desorption. Afterward, the gas is condensed in the water cooling condenser 44, and the resulting liquid is then separated into water and the solvent by the water separator 22 in the dry cleaning apparatus itself. The thus separated solvent is then returned to the clean tank 24.

Afterward, the outside air is taken in through a route comprising the valve 53, the fan 46 and the valve 52 in order to dry the active carbon layer 42. The thus dried active carbon layer 42 is ready for the next adsorption step (deodorizing step).

According to the above-mentioned system, the air throughput required to exhaust the solvent gas from the treating tank as described above is about 1/10 of that in the case of a conventional diluting deodorization method, so that the active carbon layer 42 can be miniaturized. In addition, the water cooling condenser 44 and the fan 46, which are attachment devices, can be also miniaturized, and the whole solvent recovery device can be also compacted. Needless to say, the small-sized solvent recovery device **30*a*** in Embodiment 1 may be disposed as a separate type device, as in the conventional case, and also in this case, the similar effect can be obtained.

In the method of Embodiment 1, it seems that a trace amount of the solvent component remains in the cloths. Such a remaining solvent component can be removed and recovered from the cloths by first rotating the stopped treating drum again to diffuse the solvent component in the treating tank, then stopping the treating drum again, and performing the above-mentioned deodorization. In Embodiment 1, the system utilizing the active carbon is used as the solvent recovery device, but other various systems can be naturally used such as a system utilizing another absorbent (e.g., a zeolite), a condensation/recovery system utilizing a freezer, an absorbing system in which the same kind of solvent and an oil are brought into contact with the solvent gas, and a system utilizing a combination thereof. Moreover, the similar effect can be provided by a semiclosed or closed system in which a part or all of the air separated from the solvent in the above process is reused in place of the feed air coming through the outside gas inlet.

Embodiment 2

The miniaturization of an active carbon tank leads to the curtailment of an active carbon recovery time, with the result that its running cost can be naturally reduced.

In general, a solvent used in the dry cleaner has a specific gravity three to four times as heavy as that of air. For this reason, air and the solvent remain separated sufficiently, so long as they are not agitated. For example, when an air inlet and a solvent gas outlet respectively provided in the upper and lower portions of a washing tank which is full of the solvent gas are simultaneously opened, the solvent gas naturally flows out through the lower portion of the washing tank, and at this time, air is introduced into the washing tank through the upper portion thereof. In this case, the level of the solvent gas in the washing tank descends while the solvent gas remains separated from air. In the constitution in which the solvent gas coming from the washing tank is forwarded to active carbon, the amount of the solvent gas which is treated by the active carbon is only the volume of the washing tank. In consequence, it is apparent that the solvent gas can be replaced with a small amount of air. In Embodiment 1 described above, such a principle is utilized, and the employment of the system using this principle enables the size of the active carbon tank to decrease. In the above-mentioned system, however, the solvent gas is not diluted at all with air, and therefore adsorption heat generates in large quantities when the solvent gas is adsorbed by the active carbon, so that the life span of the active carbon is shortened.

Experiments were carried out to inspect whether or not the above-mentioned system is effective to lower the concentration of the solvent gas which has passed through the active carbon, that is, whether or not the concentration of the solvent gas is lowered by the system to a level of 50 ppm or less so as to keep to the Atmospheric Pollution Preventive Law and other laws. As a result, it was found that the concentration of the solvent gas on the primary side (the inlet side) of the active carbon tank was too high, 1,000,000 ppm, and that the above-mentioned system was not effective to lower the concentration of the treated solvent gas. In addition, since a great deal of adsorption heat generated as described above, it could not be carried out safely to lower the concentration of the exhausted solvent gas. As a measure to lower the gas concentration, the active carbon tank must be aggrandized sufficiently, which is against the object of decreasing the amount of the active carbon.

Thus, objects of Embodiment 2 are to decrease the amount of the active carbon, to make the most of the adsorption power of the active carbon, to inhibit the generation of the adsorption heat as much as possible, and to thereby elongate the life of the active carbon.

In order to accomplish these objects, there is provided a device for recovering a solvent for a dry cleaner in which an air inlet is provided in the top portion of the dry cleaner and a solvent gas outlet is provided in the bottom portion of the dry cleaner so that air may be introduced into the dry cleaner through the air inlet and a solvent gas generated in the dry cleaner may be led to active carbon through the solvent gas outlet, whereby the solvent gas is adsorbed and recovered by the active carbon, the aforesaid device being characterized in that another air inlet is disposed between an adsorption section of the active carbon and the solvent gas outlet so as to mix the highly concentrated solvent gas taken out from the dry cleaner with the outside air and so as to adsorb the diluted solvent gas by the active carbon. This constitution of the present invention can solve the above-mentioned problems.

In Embodiment 1 described above, the solvent gas is sucked out through the lower portion of the washing tank at the time of drying/deodorizing. One drawback of Embodiment 1 is that the concentration of the solvent is too high at the time of the adsorption. With regard to the adsorption power of the active carbon in the active carbon tank, for example, perchloroethylene is adsorbed up to 20% of the weight of the active carbon and FLON 113 is adsorbed up to about 10% of the weight of the active carbon as practical loads. However, the amount of the active carbon depends upon an air flow which passes therethrough irrespective of the load of the adsorbed solvent, and thus if a large amount of air is used, the amount of the active carbon also increases, as described above. Here, it has been found that when the highly concentrated solvent gas is diluted with air in an allowable range and when the diluted solvent gas is afterward forwarded to the active carbon tank, the adsorption heat can be decreased at the time of the active carbon adsorption, and the amount of the necessary active carbon can also be minimized.

Generally, in the device for the active carbon recovery, the solvent gas is adsorbed by the active carbon and is afterward separated from the active carbon by the use of water vapor to recover the active carbon. In addition, the active carbon is then dried so as to recover the adsorption power thereof. This drying can be achieved by introducing the outside air into the active carbon tank, and then passing the air as a drying air through the active carbon. In Embodiment 2, for example, the air inlet for taking in the outside air therethrough may be also opened in the adsorbing step of the active carbon, whereby the desired effect can be obtained only by changing the operation without any additional investment of devices. That is, when the air inlet and the solvent outlet in the upper and lower portions of the washing tank are opened, the air inlet disposed on the upstream side of the active carbon tank is also opened simultaneously. Then, a suction fan attached in the active carbon tank is driven, so that the highly concentrated solvent gas coming from the dry cleaner is diluted with the outside air and is then adsorbed by the active carbon. In such a case, a small amount of the active carbon is enough, and a small amount of the absorption heat only generates, which elongates the life of the active carbon.

Figure 4:
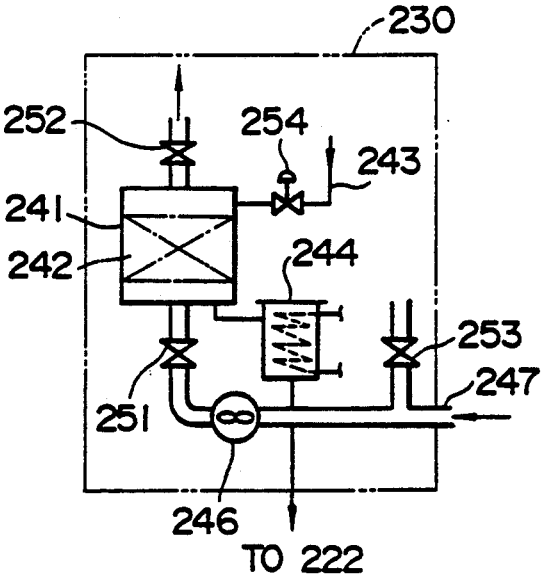
FIG. 4 is a piping view regarding another embodiment of the miniaturized solvent recovery device.
Figure 3:
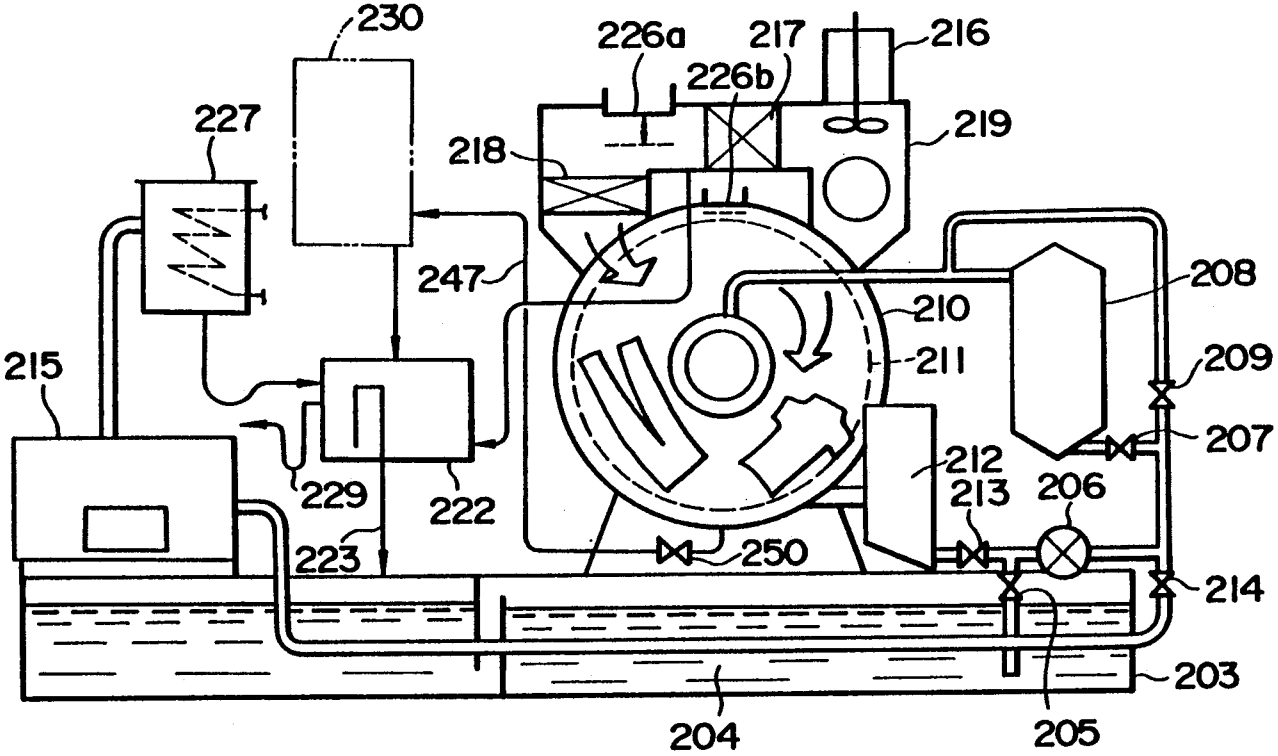
FIG. 3 is a system view of a dry cleaning apparatus regarding another embodiment of the present invention.

FIG. 3 illustrates the whole dry cleaner regarding Embodiment 2. FIG. 4 is a detailed drawing of an active carbon recovery portion of the solvent recovery device regarding Embodiment 2.

In the first place, reference will be made to the operation process of the dry cleaner in accordance with FIG. 3. Cloths are thrown into a rotary drum 211 arranged in a treating tank 210. A solvent 204 in a solvent tank 203 is sucked up through an outlet valve 205 by a solvent pump 206 and is then introduced into the treating tank 210 via a filter by-pass valve 209. When a certain amount of the solvent 204 is stored in the treating tank 210, the solvent is circulated from the treating tank 210 through a button trap 212, an intermediate valve 213, a solvent pump 206, a solvent filter inlet valve 207 and a solvent filter 208 to the treating tank 210 by the rotation of the rotary drum 211, whereby washing is carried out. Solid contaminants are collected by the solvent filter 208. After a certain period of time has elapsed, the contaminated solvent is forwarded to a distiller 215 via the button trap 212, the intermediate valve 213, the solvent pump 206 and a distiller valve 214. In the distiller 215, the solvent and water are evaporated by heating, and the resultant vapor is guided into a condenser 227, in which it is then condensed and liquefied. The resultant liquid is then allowed to flow into a water separator 222, in which water is then separated from the solvent by the utilization of a difference between specific gravities thereof. The thus separated water is finally drained through a drain pipe 229. On the other hand, the separated solvent is returned to the solvent tank 203 via a solvent recovery pipe 223, and afterward it is reused as the washing liquid. After the washing, the rotary drum 211 is rotated at a high speed to remove the solvent from the cloths by utilizing centrifugal force. The thus removed solvent liquid is also forwarded to the distiller 215 by the above-mentioned procedure.

Next, the cloths are subjected to a drying step in which instruments in an air duct 219 are used for the drying. As the instruments in the air duct 219, a fan 216, an air cooler 217 and an air heater 218 are arranged therein. The air heater 218 supplies hot air which is applied to the cloths so as to evaporate the solvent therefrom, and the evaporated solvent is then condensed and recovered by the air cooler 217. Even after the drying has been performed for a certain period of time, the solvent gas having a concentration corresponding to a gas concentration at the outlet of the air cooler 217 is present in the treating tank 210 and the air duct 219. Here, the recovery device for the solvent gas regarding Embodiment 2 is driven in order to recover the solvent gas. As shown in FIG. 3, in the case that the air duct 219 is located on the treating tank 210, a portion 226*a* functions as the outside air inlet, and in the case that the air duct 219 is located below the tip of the treating tank 210, a portion 226*b* functions as the outside air inlet. Reference numeral 250 is a solvent gas outlet damper, and numeral 247 is a solvent gas conduit connected to an active carbon recovery device 230. The solvent gas conduit 247 is connected to an active carbon tank 241 through a blower 246, as shown in FIG. 4. Reference numeral 242 is active carbon, numeral 251 is an active carbon damper, and 252 is an active carbon outlet damper. The above-mentioned blower 246 may be disposed on the downstream side of the active carbon outlet damper. Reference numeral 253 is an air inlet damper which is the most important constitutional portion in Embodiment 2.

At the time of the deodorization of the dry cleaner, the treating drum 211 and the fan 216 are stopped, so that the movement of the gas in the treating tank 210 and the air duct 219 is also stopped, and the solvent gas does not move any more. At this time, the solvent gas has a higher concentration in the lower portion of the treating tank 210. Under such situations, when the active carbon inlet and outlet dampers 251, 242 are opened and the blower 246 is rotated, and simultaneously when the air inlet damper 253 is also opened, an air stream is introduced through the air inlet damper 253, is then allowed to pass through the active carbon inlet damper 251, and is exhausted through the active carbon outlet damper 252. After several seconds, the solvent gas outlet damper 250 is opened, and then immediately the outside air inlet 226*a* or 226*b* is opened. By this procedure, the solvent gas in the treating tank 210 is led into the solvent gas conduit 247 without leaking out. A concentration of the solvent gas which has been just discharged from the treating tank 210 is equal to that of the gas in the treating tank. That is, the concentration of the solvent gas coming from the treating tank 210 is similar to that of the gas at the outlet of the air cooler and is a saturated concentration at a temperature of the gas itself. This solvent gas is mixed with air introduced through the air inlet dampler 253 on the way to the active carbon 242. The concentration of the solvent gas which is adsorbed by 5 the active carbon 242 depends upon the amount of air introduced through the air inlet damper 253 and that of the solvent gas from the solvent gas outlet damper 250, and therefore the power of the blower 246 depends upon a dilution of the solvent gas and the amount of the air introduced through the air inlet damper 253. Usually, an about three-fold dilution is practical. The solvent gas which has passed through the active carbon 242 is exhausted in a concentration of 50 ppm (theoretically 0 ppm) or less to the atmosphere. This step is usually carried out in 2 to 3 minutes The solvent gas in the treating tank 210 is replaced with the air introduced through the outside air inlet damper 226*a* or 226*b*, whereby the deodorization is over.

When the absorbing ability of the active carbon 242 has been lost, the active carbon inlet and outlet dampers 251 and 252 are closed so as to permit introducing water vapor into the active carbon tank 242 via a vapor inlet pipe 243 and a vapor inlet valve 254, so that the solvent component in the active carbon vaporizes by heat energy of the water vapor. The vaporized solvent gas is condensed and liquefied in a condenser 244, and it is then forwarded to the water separator 222, in which the so-called desorption (recovery) is then carried out. After the desorption, air is introduced into the active carbon tank 241 through the air inlet damper 253 with the aid of the blower 246 in order to dry the active carbon 242. At this time, needless to say, the active carbon inlet and outlet dampers 251 and 252 are opened, and the vapor inlet valve 254 is closed. As is apparent from the foregoing, the air inlet damper 253 is opened when the adsorption is performed by the active carbon and when the latter is dried.

As described above in detail, according to Embodiment 2, the solvent gas taken out from the dry cleaner is diluted with air, and therefore the adsorption of the highly concentrated solvent gas by the active carbon can be escaped advantageously, with the result that it can be prevented that the active carbon is deteriorated by adsorption heat. In addition, the enhancement of the exhaust gas concentration can also be prevented. In consequence, it is unnecessary to aggrandize the active carbon tank or to increase the amount of the active carbon with the intention of maintaining the concentration of the exhaust gas at a low level.

Embodiment 3

As described above, it can be expected that the conventional problem of air pollution is substantially solved by the technique set forth in Embodiment 1 and that the cost necessary to recover the solvent is descreased remarkably. Nevertheless, the running cost (costs of steam, cooling water and the like) of a solvent recovery step is still high, and periodic maintenance is also required.

As a trend in recent years, a process called a closed system is often employed in which a solvent gas in a dry cleaning apparatus is not deodorized. However, in such a type of dry cleaning apparatus, the remaining solvent gas in a treating tank flows into a working area and causes the working circumstances to worsen, when a door of the treating tank is opened to take out washed cloths therefrom.

Embodiment 3 regarding the present case provides a dry cleaning method by which the above-mentioned problems of the running cost in the solvent recovery step, the periodic mentenance and the bad working circumstances in the closed system can be all solved.

According Embodiment 3, the above problems can be solved by a method for dry cleaning which comprises the steps of stopping the rotation of a treating drum in a deodorizing step, introducing the outside air into a treating tank through an upper opening provided in the upper portion of the treating tank or the upper portion of a recovery air duct, simultaneously exhausting a solvent gas from the treating tank through a lower opening provided in the lower portion of the treating tank or a button trap portion so slowly as not to agitate the solvent gas in the treating tank by a gas delivery device in the condition that the treating drum is stopped, in order to forward the solvent gas to an air tank, opening a door of the treating tank and then taking out washed cloths therefrom, throwing other unwashed cloths thereinto and then closing the door, and returning the solvent gas in the air tank to the treating tank through a lower opening of the treating drum by the air delivery device and simultaneously releasing the air from the treating tank through the upper opening.

Figure 5:
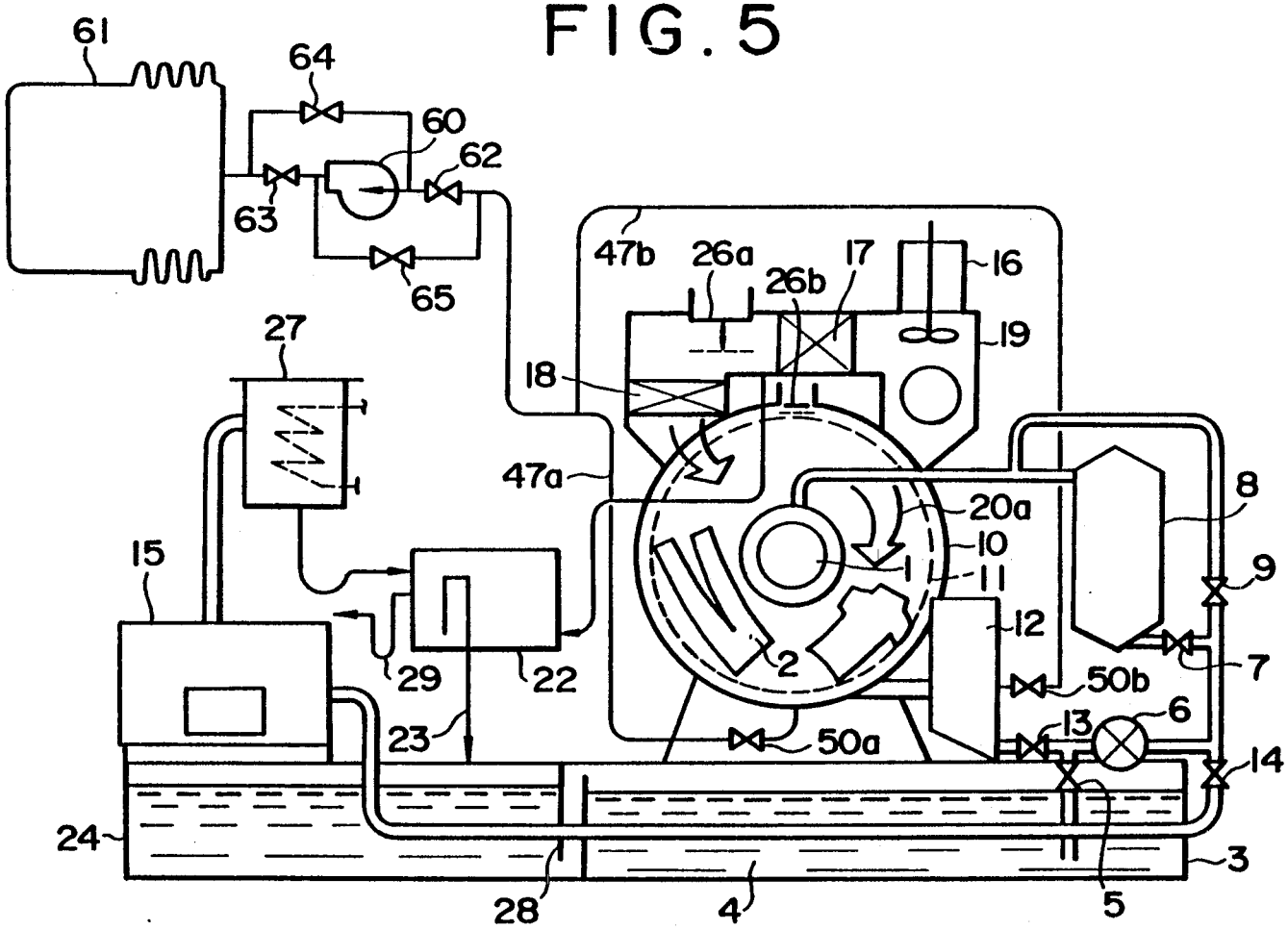
FIG. 5 is a system view of the dry cleaning apparatus regarding still another embodiment of the present invention.
Figure 6:
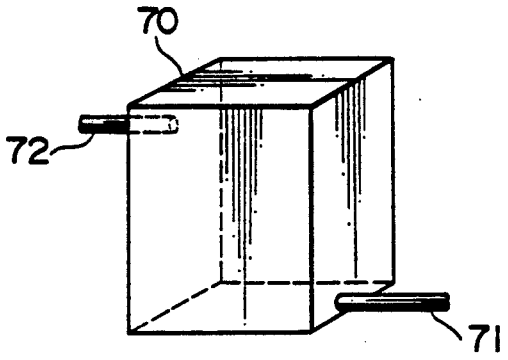
FIG. 6 is a perspective view of an air box which is used in place of an air bag in FIG. 5.

Now, the present invention will be described in reference to Embodiment 3 of attached drawings. FIG. 5 is the system diagram of a dry cleaning apparatus illustrating Embodiment 3 of the present invention, and FIG. 6 is a perspective view of an air box which takes the place of an air bag in FIG. 5. In FIG. 5, the same members as in FIG. 9 (regarding a conventional case) are indicated by the same reference numerals as in FIG. 9.

Differences between the embodiments of FIGS. 5 and 9 will be described. In this embodiment, the outside gas is introduced into a treating tank 10 through an upper opening on a recovery air duct 19 or the treating tank 10, and simultaneously a solvent gas present in the treating tank 10 or the recovery air duct 19 is slowly exhausted to a gas delivery device 60 through the lower portion of the treating tank 10 or a lower opening of a button trap 12 in the condition that the treating drum is stopped. Therefore, the treating tank 10 is connected to the gas delivery device 60 via a valve 50*a* or 50*b* and a duct 47*a* or 47*b*, and this constitution is not seen in the embodiment in FIG. 9. The arrangement of the valve 50*a*, 50*b* and the duct 47*a* or 47*b* is shown in FIG. 1, but the embodiment of FIG. 5 is different from that of FIG. 1 in that in FIG. 5, a small-sized solvent recovery device 30*a* in FIG. 1 is replaced with the gas delivery device 60 and the air bag 61 which are connected to the duct 47*a* or 47*b*. Additionally, in FIG. 5, valves 62 to 65 for switching the stream direction of air are provided.

FIG. 6 is the detailed perspective view of the air box 70 which takes the place of the air bag 61 in FIG. 5.

Next, reference will be made to the function of the embodiment in FIG. 5 in which the air bag 61 is incorporated in the dry cleaning apparatus.

In the first place, washing and drying are conventionally carried out in the dry cleaning apparatus, and the treating drum 11 is then stopped. Afterward, a damper 26*a* or 26*b* which is an upper opening for the introduction of the outside gas is opened as depicted by each dotted line, so that the solvent gas in the treating tank 10 is forwarded to the air bag 61 via the valve 50*a* or 50*b*, the valve 62, the gas delivery device 60 and the valve 63 in the direction of an arrow 20*a* for a certain period of time. This operation should be carried out by using air in such a small amount that the outside air introduced through the damper 26*a* or 26*b* is not mixed with the solvent gas. At this time, the valves 64 and 65 are closed. This operation permits the outside air to be introduced into the treating tank 10 through the damper 26*a* or 26*b*.

Next, a door 1 of the treating tank 10 is opened to take out washed cloths 2 therefrom, and other unwashed cloths 2 are then thrown into the treating tank 10 and the door 1 is closed. While the damper 26*a* or 26*b* is opened, the solvent gas in the air bag 61 is delivered into the treating tank 10 through the lower portion thereof via a valve 69, the gas delivery device 60, the valve 65 and the valve 50*a* or 50*b* by the gas delivery device 60, whereby the air in the treating tank 10 is exhausted to the outside through the damper 26*a* or 26*b*. In this Embodiment 3, there has been described the case where the solvent gas in the treating tank 10 is received in the air bag 61. However, when the solvent gas is received in the air box 70 in FIG. 6, just the same mechanism can also be obtained. Furthermore, in Embodiment 3, as a manner of returning the solvent gas in the air bag 61 to the treating tank 10, the gas is forwarded by the use of the gas delivery device 60. Needless to say, it is also possible to inversely suck the air in the treating tank 10 through the damper 26*a* or 26*b* by the gas delivery device 60. In this case, the interior in the treating tank 10 is put under a negative pressure, and the solvent gas in the air bag 61 is sucked into the treating tank 10 through the valve 50*a* or 50*b*. Anyway, the feature of the present invention resides in the utilization of the fact that the solvent gas is much heavier than air and is difficult to diffuse therein.

Embodiment 4

Embodiment 4 is directed to a dry cleaning apparatus characterized by having an upper opening provided in the upper portion of a treating tank or the upper portion of a recovery air duct to introduce the outside air into the treating tank in a deodorization step in the condition that the rotation of the treating drum is stopped, and having a lower opening provided in the lower portion of the treating tank or a button trap portion to exhaust a solvent gas in the treating tank so slowly as not to agitate the solvent gas by the use of a gas delivery device in the condition that the treating drum is stopped, whereby after the solvent gas is forwarded into an air tank, a door of the treating tank is opened and washed cloths are then taken out therefrom, and other unwashed cloths are thrown into the treating tank and the door is then closed, and afterward the solvent gas in the air tank is returned to the treating tank through a lower opening of the treating drum and simultaneously the air in the treating tank is released through the upper opening.

Figure 8:
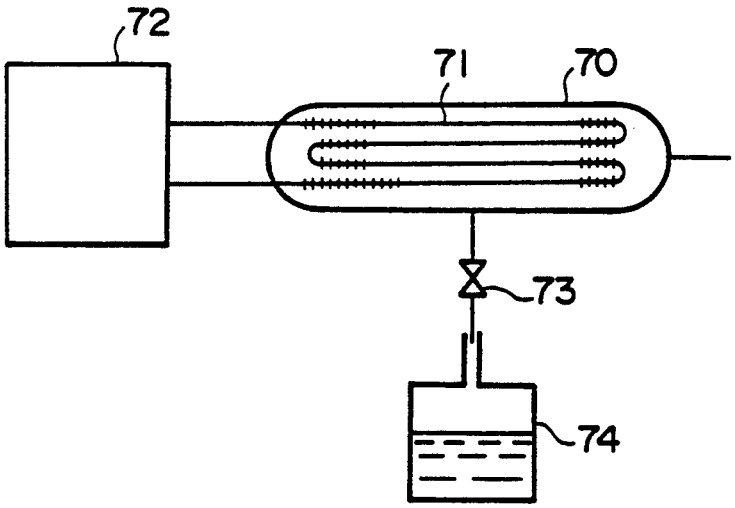
FIG. 8 is a sectional view regarding another embodiment of a tank shown in FIG. 7.
Figure 7:
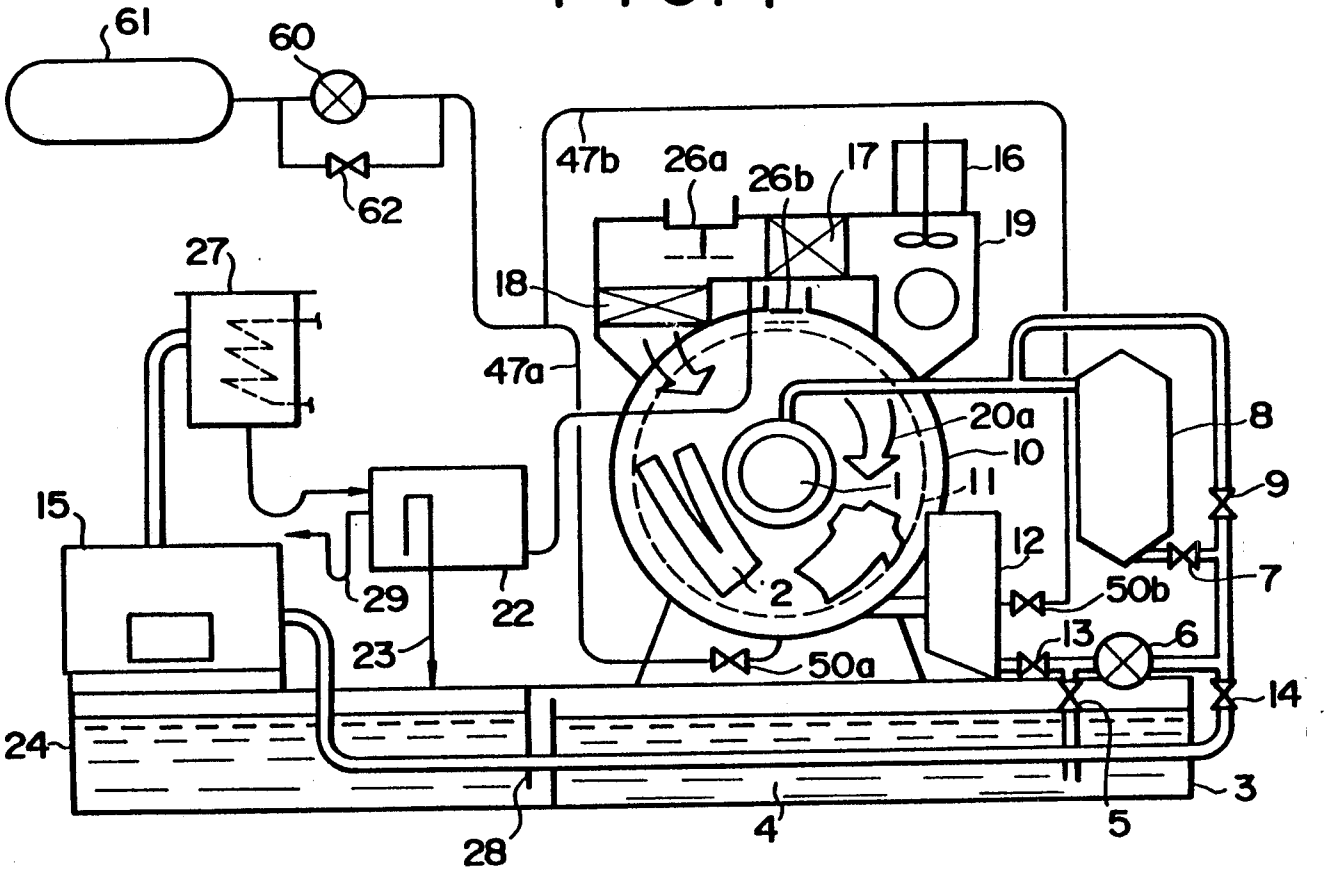
FIG. 7 is a system view of the dry cleaning apparatus regarding a further embodiment of the present invention.

Now, Embodiment 4 will be described in reference to drawings. FIG. 7 is a system diagram of Embodiment 4 regarding a dry cleaning apparatus. FIG. 8 shows a tank in which a cooling coil is arranged to condense and recover a part of a solvent gas.

Differences between the embodiments of FIGS. 7 and 9 will be described. In Embodiment 4 of FIG. 7, the outside air is introduced into a treating tank 10 through an upper opening provided in the upper portion of a recovery air duct 19 or the treating tank 10. The lower portion of the treating tank 10 or the lower opening of a button trap 12 is connected to a gas compressor 60 via a valve 50*a* or 50*b* and a duct 47*a* or 47*b*, so that a solvent gas in the treating tank 10 or the recovery air duct 19 can be slowly exhausted in the condition that the rotation of a treating drum 11 is stopped, while the outside air is introduced into the treating tank 10. This constitution of FIG. 7 is different from that of FIG. 9. The arrangement of a valve 50*a* or 50*b* and a duct 47*a* or 47*b* is shown in FIG. 1, but the embodiment of FIG. 7 is different from that of FIG. 1 in that in FIG. 7, a tank 61, the gas compressor 60 connected to the duct 47*a* or 47*b* and the tank 61, and a valve 62 by-passing the gas compressor 60 are arranged in place of a small-sized solvent recovery device 30*a* in FIG. 1.

FIG. 8 shows an embodiment in which a tank 70 having a cooling coil 71 is used in place of the tank 60 in FIG. 7, whereby the solvent gas can be partially condensed and recovered therein. In FIG. 8, reference numeral 72 is a freezer, numeral 73 is a solvent recovery valve, and 74 is a solvent recovery tank.

Reference will be made to the function of Embodiment 4 in FIG. 7 in which the gas compressor 60 and the tank 61 are incorporated in the dry cleaning apparatus.

In the first place, washing and drying are conventionally carried out in the dry cleaning apparatus, and a treating drum 11 is then stopped. Afterward, a damper 26*a* or 26*b* which is an upper opening for the introduction of the outside gas is opened as depicted by each dotted line, so that the solvent gas in the treating tank 10 or the recovery air duct 19 is forwarded to the tank 61 via the valve 50*a* or 50*b* and the gas compressor 60 in the direction of an arrow 20*a* for a certain period of time. At this time, the valve 62 is naturally closed. This operation should be carried out by using air in such a small amount that the outside air introduced through the damper 26*a* or 26*b* is not mixed with the solvent gas. This operation permits the outside air to be introduced into the treating tank 10 through the damper 26*a* or 26*b*.

Next, a door 1 of the treating tank 10 is opened to take out washed cloths 2 therefrom, and other unwashed cloths 2 are then thrown into the treating tank 10 and the door 1 is closed. While the damper 26*a* or 26*b* is opened, the solvent gas in the tank 61 is delivered into the treating tank 10 through the lower portion thereof via the valve 62 and the valve 50*a* or 50*b*, whereby the air in the treating tank 10 is exhausted to the outside through the damper 26*a* or 26*b*. In this Embodiment 4, there has been described the case where the solvent gas in the treating tank 10 is received in the tank 61.

Next, reference will be made to the case where the solvent gas in the treating tank 10 is received in the cooling coil-carrying tank 70.

In this case, a part of the solvent gas received in the tank 70 is cooled and condensed by the cooling coil 71 connected to the freezer 72, and is then stored on the bottom of the tank 70. The liquefied solvent 4 which is stored in the tank 70 is then separated from the uncondensed solvent gas in the tank 70. Afterward, the uncondensed solvent gas is returned to the treating tank 10, as in the above-mentioned embodiment of FIG. 7. On the other hand, the condensed solvent 4 is returned to the solvent recovery tank 74 by opening the solvent recovery valve 73. In this case, the condensed solvent 4 may be forwarded to a water separator 22 instead of using the solvent recovery tank 74.

Anyway, the feature of the present invention resides in the utilization of the fact that the solvent gas is much heavier than air and is difficult to diffuse therein, whereby the solvent gas in the treating tank is exhausted. In addition, since the solvent gas is compressed by the use of the gas compressor and is then stored, the tank can be miniaturized. In some cases, the dilute solvent gas in the deodorization step may be compressed, liquefied and concentrated.

Embodiments 3 and 4 of the present case are constituted as described above. Therefore, when the washed cloths are taken out from the dry cleaning apparatus, the amount of the solvent gas which leaks into the working area through the door of the dry cleaning apparatus can be inhibited to a minimum level, with the result that good working circumstances can be maintained. In addition, a worker can be released from a strong solvent odor at the time of opening the door. Moreover, the solvent gas, which is floating in the working area in the conventional case, can be received in the air tank or the other tank and then returned to a recovery tank. In consequence, the loss of the solvent can be decreased, and FLON pollution can also be reduced very effectively.

What is claimed is:

1. A method for dry cleaning which comprises the steps of stopping the rotation of a treating drum in a deodorizing step, introducing the outside air into a treating tank through an upper opening provided in the upper portion of said treating tank or the upper portion of a recovery air duct, simultaneously exhausting a solvent gas from said treating tank through a lower opening provided in the lower portion of said treating tank or a button trap portion so slowly as not to agitate said solvent gas in said treating tank by a gas delivery device in the condition that said treating drum is stopped, in order to forward said solvent gas to an air tank, opening a door of said treating tank and then taking out washed cloths therefrom, throwing other unwashed cloths thereinto and then closing the door, and returning said solvent gas in said air tank to said treating tank through a lower opening of said treating drum by said air delivery device and simultaneously releasing the air from said treating tank through said upper opening.

2. A method for dry cleaning, comprising the steps of; providing a treating drum with solvent gas and providing garments to be treated in the treating drum; rotating the treating drum; stopping rotation of the treating drum; providing a deodorizing step including introducing outside air into the treating drum through an upper opening provided in an upper portion of the treating drum, and simultaneously slowly exhausting the solvent gas from the treating drum so as to not agitate the solvent gas; directing the solvent gas through a gas delivery device to a solvent gas tank; opening a door provided in the treating drum and removing washed garments therefrom; depositing unwashed garments into the treating drum; closing the treating drum door; returning the solvent gas to the treating drum from the solvent tank through the lower opening of the treating drum via the gas delivery device, and simultaneously releasing air from said treating tank through said upper opening.

* * * * *